US006338453B1

(12) United States Patent
Meyer

(10) Patent No.: US 6,338,453 B1
(45) Date of Patent: Jan. 15, 2002

(54) WINDING DEVICE HAVING A WINDING SHAFT AND ADDITIONAL BEARINGS

(75) Inventor: Helmut Meyer, Troisdorf (DE)

(73) Assignee: Reifenhäuser GmbH & Co. Maschinenfabrik, Troisdorf (DE)

( * ) Notice: Subject to any disclaimer, the term of this patent is extended or adjusted under 35 U.S.C. 154(b) by 0 days.

(21) Appl. No.: 09/453,384

(22) Filed: Dec. 2, 1999

(51) Int. Cl.[7] ..... B65H 49/26; B65H 18/10; B65H 49/32; B65H 75/18

(52) U.S. Cl. ..... 242/598.3; 242/598; 242/598.4; 242/599.3; 242/545; 242/546

(58) Field of Search ..... 242/598.3, 598, 242/598.4, 599.3, 546, 545

(56) References Cited

U.S. PATENT DOCUMENTS

| | | | | |
|---|---|---|---|---|
| 3,038,680 A | | 6/1962 | Rose | |
| 3,537,665 A | * | 11/1970 | Shumaker | 242/598.4 |
| 3,981,509 A | * | 9/1976 | Myer | 242/598.4 |
| 5,553,805 A | * | 9/1996 | Ruegg | 242/599.3 X |

FOREIGN PATENT DOCUMENTS

| | | |
|---|---|---|
| DE | 1 099 336 | 2/1961 |
| DE | 75 36 100 | 3/1976 |
| DE | 44 39 908 A1 | 6/1995 |
| DE | 196 36 184 A1 | 3/1998 |
| GB | 1136137 | 12/1968 |

* cited by examiner

*Primary Examiner*—Donald P. Walsh
*Assistant Examiner*—Minh-Chau Pham
(74) *Attorney, Agent, or Firm*—Pauley Petersen Kinne & Fejer

(57) ABSTRACT

A winding device, having a winding shaft, which can be inserted into and removed from the winding device, and a winding element and bearing journals protruding from both ends in the direction of the center axis of the winding shaft. The winding device has two outer bearings for receiving the bearing journals for rotatable seating of the winding shaft in the winding device, and an additional bearing for the winding shaft is assigned, spaced apart, to each outer bearing. Each outer bearing has a coupling device, and the coupling devices are displaceable along the center axis of the winding shaft and can be connected with or disconnected from the respective ends of the bearing journals. The additional bearings, acting as inner bearings, are formed between the ends of the bearing journals, which can be connected with the outer bearings, and the winding element on the bearing journal of the winding shaft.

20 Claims, 5 Drawing Sheets

WINDING DEVICE HAVING A WINDING SHAFT AND ADDITIONAL BEARINGS

BACKGROUND OF THE INVENTION

1. Field of the Invention

This invention relates to a winding device, having a winding shaft, which can be inserted into and removed from the winding device, and a winding element and bearing journals protruding from both ends in a direction of a center axis of the winding shaft, wherein the winding device has two outer bearings for receiving the bearing journals for rotatable seating of the winding shaft in the winding device, and has an additional bearing for the winding shaft spaced apart to each outer bearing.

2. Description of Prior Art

Such winding devices are known in many variations and are used, for example, for winding a continuously fed web of material, such as a plastic foil, to form a so-called coil, which is wound on the winding shaft. Customarily a tube made, for example, of cardboard, is pushed on a winding element of the winding shaft, which forms a core of the subsequent coil.

A problem with the known winding devices is flexing of the winding shaft, so far unavoidable and considerable, between its seats formed at the bearing journals in end areas. This flexing has negative effects on the winding quality obtained.

Furthermore, at the start of the winding process, for example when the fed-in material begins to be wound, the winding shaft has the smallest diameter, its own diameter or the outer diameter of a tube pushed on the winding shaft. Because of this smallest diameter, the winding shaft reaches its greatest number of revolutions here. But this maximum number of revolutions is limited by the critical bending speed of the winding shaft, which is a result of the flexing of the shaft because of its own weight. But this critical bending speed to which the winding shaft can be accelerated at the start of the winding process, limits the efficiency of the winding device, so that a further increase in the critical bending speed of the winding shaft is desirable.

A winding device is known from German Patent Reference DE 44 39 908, wherein a compensating force is exerted at the shaft ends of the winding shaft, by means of which the flexing of the winding shaft can be minimized. It is proposed for this purpose to support the winding shaft by extendible cylinders via support rollers or bearing rings, and to simultaneously introduce the desired compensation force. However, with this known device it is disadvantageous that a separate energy source is always required for the cylinders and for generating the compensating force, which also requires a control and regulating device. Therefore the structure of the known device is elaborate and expensive. The known device can only be integrated with great difficulties into a winding device wherein the winding shafts need to be replaced by automation frequently and at high speed.

A support structure is known from German Patent Reference DE 196 36 184 A1, which is rotatably seated in a sort of a bearing basket in two bearings, which are axially spaced apart. Although the flexing of the winding shaft is reduced without additional energy or control outlay, a use of automated winding devices and the possibility of simple changing of such a winding shaft is not possible.

Furthermore, various solution suggestions for seating exchangeable shafts in a device, for example winding shafts in a winding device, are known from the prior art, such as German Patent Reference DE-AS 1 009 336, U.S. Pat. No. 3,038,680, Great Britain Patent Reference GB 1 136 137 and German Patent Reference DE 75 36 100. However, it is a property of all these known to have no provision for affecting, or respectively reducing, the flexing of the winding shaft, which leads to the problems explained.

SUMMARY OF THE INVENTION

It is one object of this invention to provide a winding device of the type mentioned at the outset, wherein flexing of the winding shaft is minimized with small outlay in order to increase the critical bending speed of the winding shaft, which has advantageous results on the efficiency of the winding device and to also improve the winding quality of the winding device with the reduction of the flexing, wherein this winding shaft preferably can be inserted into and removed out of the winding device in an automated manner, i.e. it should be exchangeable.

In accordance with this invention, this object is attained with a winding device having the characteristics described in this specification and in the claims.

According to this invention, each outer bearing is equipped with a coupling device. The coupling devices are displaceable along a center axis of the winding shaft and can be connected with or disconnected from the respective ends of the bearing journals. Additional bearings between the ends of the bearing journals, which can be connected with the outer bearings and the winding element on the bearing journal of the winding shaft are designed as inner bearings.

According to this invention, for rotatable seating of the winding shaft, an outer bearing is arranged at the end of each bearing journal and a respective inner bearing is arranged, spaced apart, at the outer bearings on a side facing away from the end of the bearing journal, so that the winding shaft is quadruple seated symmetrically in the winding device. Thus, the flexing of the winding shaft seated in the winding device is reduced to a minimum. Because of the quadruple symmetrically seated winding shaft in a dual indeterminate system, tensions, and moments resulting therefrom, are caused within the winding shaft between the bearing points, which counteract the flexing of the winding shaft under its own weight, so that flexing of the winding shaft is minimized in a surprisingly simple way.

Within the scope of this invention, a symmetrical seating is understood to be an arrangement of the bearings which is symmetrical with respect to the center of the winding shaft.

To be able to remove the winding shaft from the winding device when a desired winding length of the fed-in web of material is reached, and to replace it by a further insertable winding shaft without an interruption of the feeding of the material web, the outer bearings are equipped with respective coupling devices, which are displaceable along the center axis of the winding shaft and can be connected with or disconnected from the respective ends of the bearing journals of the winding shaft. The additional bearings used as inner bearings are arranged between the ends of the bearing journals, which can be connected with the outer bearings, and the winding element on the bearing journals of the winding shaft. From there, the winding shaft is permanently equipped with its inner bearings and, when inserted into the winding device, is also connected with the respective outer bearings of the winding device by the coupling devices acting on the winding shaft. Thus, the quadruple symmetrical seating in the winding device in accordance with this invention, and minimization of the flexing of the winding shaft resulting therefrom, is achieved. When the winding shaft is to be removed again out of the winding device, the outer bearings are separated from the winding shaft by the coupling device, so that the outer bearings can be removed from the winding device in a manner known per se and exchanged for another winding shaft, which can be inserted into the winding device.

With this design it is also possible to use winding shafts with different diameters of the winding element, for example the widely used 3" and 6" winding shafts, in the winding device of this invention. Only the bearing journals of the winding shafts must be designed the same for this purpose.

The inner bearings of the winding shaft are each formed by a bearing sleeve pushed on the area of the bearing journal facing away from the coupling device, and are seated, rotatable around the bearing journal, using seating elements. Here, the bearing sleeve forms the outermost bearing housing of the inner bearing, while the bearing journal forms the inner housing of the inner bearing. It is also possible to push at least one inner sleeve, which simultaneously forms the inner housing of the inner bearing, on the bearing journal, through which the bearing elements are rotatably connected with the bearing sleeve pushed over it as an outer bearing housing. In this case the inner bearings of the winding shaft are advantageously embodied as rolling bearings, which can also dependably absorb the loads created by the weight of the winding shaft, together with the web of material being wound onto this winding shaft.

A receiver cup, approximately U-shaped in cross section, is provided for supporting the inner bearing of the winding shaft within the winding device, into which the winding shaft can be inserted for rotatable seating in the winding device, and from which it can be removed. The automatic insertion and removal of winding shafts into, or respectively out of, the winding device in accordance with this invention is thus made possible.

A particularly solid seating of the winding shaft is achieved because the receiver cup is extended past the coupling device for the outer bearing and forms a part of the bearing bracket for the outer bearing.

In an advantageous further embodiment of this invention, the bearing sleeve of the inner bearing has an annular circumferential groove on the outside. The receiver cup has a strip, which corresponds with it and which, with the winding shaft inserted into the receiver cup, interlockingly engages the circumferential groove of the bearing sleeve. Axial displacement of the bearing sleeve of the inner bearing of the winding shaft during the winding process is thus prevented.

For a further increase of the fixation and support of the inner bearings of the winding shaft on the winding device, the strips forming the U-shaped cross section of the receiver cup have a distance from each other, which corresponds to the diameter of the bearing sleeve of the inner bearing. Thus the bearing sleeve can be interlockingly placed into the receiver cup and can be inserted, or respectively removed, without problems through the remaining free space between the strips forming the U-shaped cross section of the receiver cup.

In order to be able to insert the winding shafts of the winding device of this invention without problems into the latter, or respectively to take them out again, a cylinder is held in the winding device, is axially displaceable in relation to the center axis of the winding shaft, forms the coupling device for the outer bearings. A center sleeve is seated, rotatable by the outer bearing, and the center sleeve engages the free end of the bearing journal during a displacement of the cylinder in a direction toward the winding shaft and seats the winding shaft rotatably in the outer bearing. This engagement can be released again by displacing the cylinder in the opposite direction, and the winding shaft can be released.

To insert the winding shaft into the winding device in accordance with this invention, the winding shaft is inserted with bearing journals into the respectively provided receiver cups of the winding device. The inner bearings formed on the bearing journal of the winding shaft are supported on the winding device and cause a double rotatable seating of the winding shaft. A connection between the free end of the bearing journal of the winding shaft and the outer bearing, which rotatably seats the center shaft, is then accomplished in this position by displacing the cylinder with the center shaft rotatably seated therein in the direction toward the center axis of the winding shaft. Now the quadruple symmetrical seating in accordance with this invention, of the winding shaft results, which minimizes flexing of the winding shaft. Following the end of the winding process on the winding shaft seated in this way in the winding device, the cylinder is displaced in the opposite direction, whereupon the center shaft disengages with the bearing journal of the winding shaft and the connection with the outer bearings is broken. It is now possible to take the winding shaft out of the receiver cups of the winding device in the reverse direction.

With the above explained structural design it is possible to perform an automated changing of the winding shafts in the winding device. It is thus, for example, merely necessary to fasten the coupling device and the receiver cups on changing arms, known per se, of a winding device in the area of the free end thereof, so that the winding shaft can be inserted with a pivot movement of the changing arms into a receiving position, and the winding shaft can be taken out of the receiver cups by means of a further pivot movement of the changing arms into a removal position.

The subsequent equipping of already present winding devices with the quadruple symmetrical seating proposed by this invention, for minimizing the flexing of the winding shaft, is in particular possible by means of this simple construction.

In an advantageous further embodiment of the winding device in accordance with this invention, on its free end the center shaft has a clamping cone, which can be brought into engagement with a corresponding conical clamping bore axially cut into a free end of the bearing journal. Thus a particularly solid connection is possible between the outer bearings and the bearing journals of the winding shaft for providing the quadruple symmetrical seating in accordance with this invention.

With very productive winding devices of this invention, which have great winding widths in particular, the center shaft can be rotatably driven by a rotary drive in order to transmit rotating movement to the winding shaft upon engagement of the center shaft with the bearing journal of the winding shaft, and thus to rotatably drive the winding shaft during the winding operation.

A coupling sleeve can be placed on the area facing the free end of the bearing journal, which is connected, fixed against relative rotation, with the bearing journal by means of a shaft-hub connection, and on whose free end the clamping bore is provided. It is possible by means of this design to equip already existing winding shafts of different diameters without a large outlay with an inner bearing using the bearing sleeve pushed thereon, as well as with a conical clamping bore provided for the engagement of the coupling device on the free end of the bearing journal by means of the coupling sleeve.

A pneumatic valve can be provided inside the coupling sleeve for a compressed air connection to the winding shaft, such as is known, for example, for actuating clamping cheeks, which can be extended out of the surface of the winding element of the winding shaft for fixing a tube in place, which is pushed thereon for winding of the fed web of material thereon.

Also, the bearing sleeve which is rotatably arranged on the bearing journal for creating the inner bearing, can be rotatably seated with respect to the bearing journal using an additional roller bearing in the area of its end facing the coupling sleeve in order to prevent an interference with the coupling sleeve adjoining there, which is connected, fixed against relative rotation, with the bearing sleeve.

The reduction of the flexing of the winding shaft which can be achieved with the quadruple symmetrical bearing, in accordance with this invention, of the winding shaft can be realized in connection with the most varied constructions of winding devices. It can be advantageously employed with so-called contact winders, wherein a direct contact between a so-called contact roller and the winding shaft exists, and also with so-called gap winders, wherein the contact roller and the winding shaft have a defined gap distance from each other, which can be preset, in order to minimize the flexing of the winding shaft and to improve the winding result as well as the winding device output.

BRIEF DESCRIPTION OF THE DRAWINGS

This invention will be described in greater detail in what follows by means of an exemplary embodiment in the drawings, wherein.

DETAILED DESCRIPTION OF PREFERRED EMBODIMENTS

Figure 4:
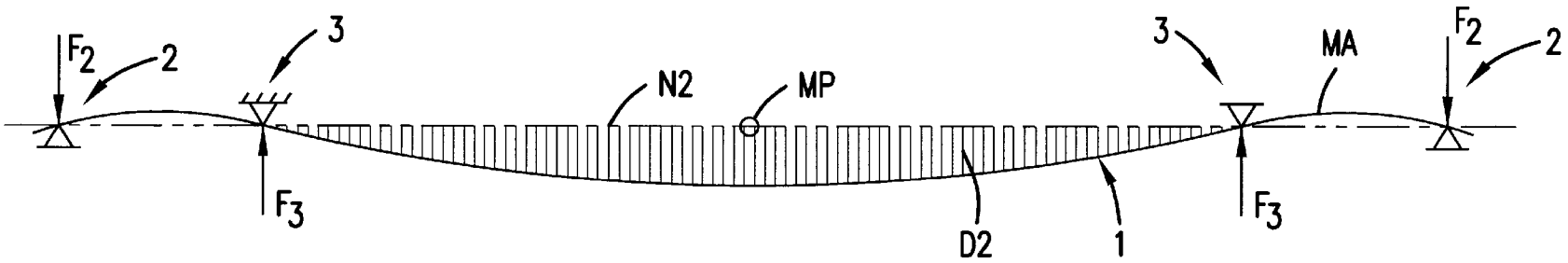
FIG. 4 shows a flexing or deflection of a quadruple seated winding shaft of this invention.
Figure 5:
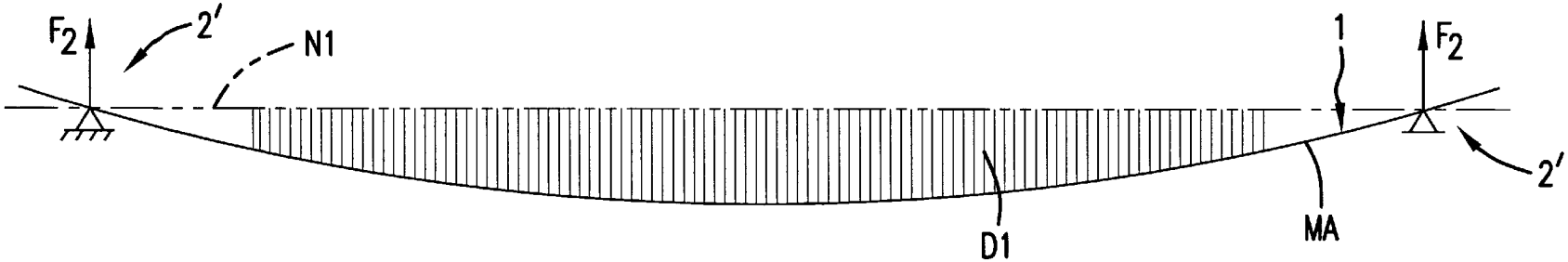
FIG.5 PRIOR ART
FIG. 5 shows a schematic view of a flexing or deflection of a doubly seated winding shaft in accordance with the prior art.

First, functioning of a winding device in accordance with this invention will be shown in comparison with the prior art by referring to FIGS. 4 and 5.

FIG. 5 shows the image of the deformation of a winding shaft 1, which is rotatably seated at its two ends in outer bearings identified by 2', in a schematic representation. Because of its own weight, the winding shaft 1, as well as possibly that of the delivered web of material already wound on the winding shaft 1, a flexing D1 of the winding shaft occurs between the outer bearings 2', because of which the center axis, identified by MA, greatly deviates from the theoretical center axis of the winding shaft, identified by line N1, between the outer bearings 2'. Because of its own weight the winding shaft 1 sags down between the outer bearings 2'. But this strong flexing for one limits the critical bending speed of the winding shaft 1 during the start of the winding process, which sets limits to the speed of the delivered web of material to be wound, and the further increasing flexing also has a negative effect during the continued winding of the web of material on the winding shaft 1 and, for example, can lead to the formation of creases inside the wound-up web of material.

Figure 6:
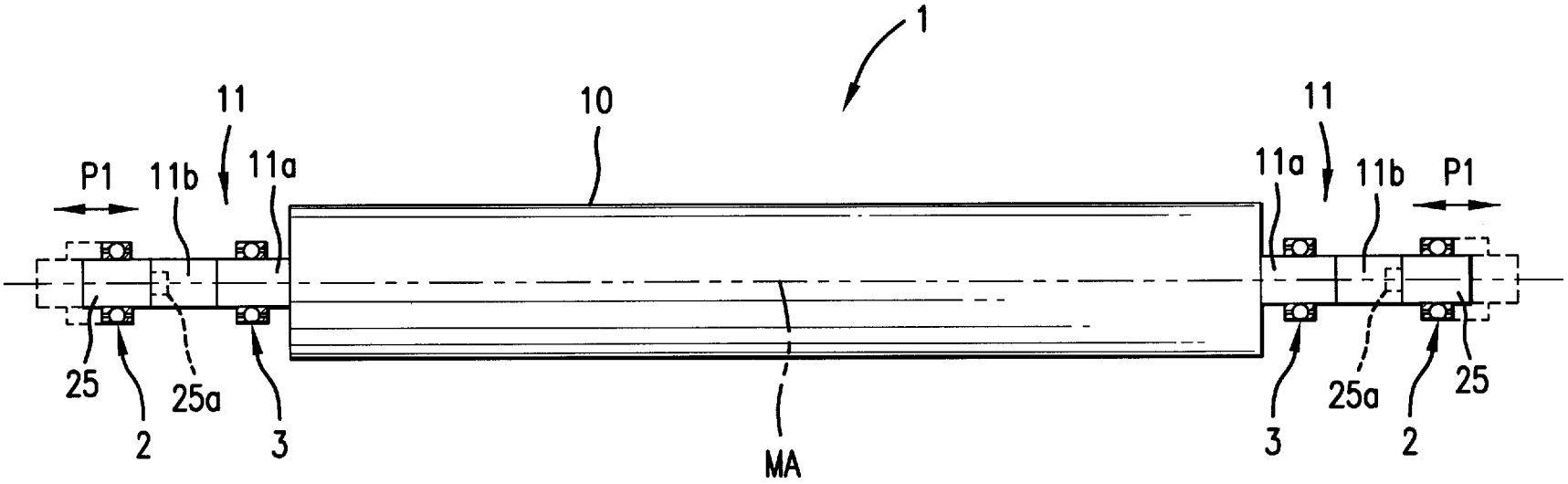
FIG. 6 shows a schematic view of a seating of the winding shaft in the winding device in accordance with this invention.

In contrast thereto, FIGS. 4 and 6 present a schematic view of a bearing of the winding shaft 1, such as is employed with the winding device of the invention. Here, the two ends of the winding shaft 1 are rotatably seated in respectively two bearings 2, 3 in the winding device, not represented here, wherein the bearings assigned to the free end of the winding shaft 1 are designated as outer bearings 2. Bearings, respectively identified as inner bearings 3, are furthermore provided at a distance from the outer bearings 2 and facing away from the free end of the winding shaft 1, in which the winding shaft 1 is also rotatably seated. By means of this, a quadruple seating of the winding shaft 1 in the winding device results in comparison with the double seated winding shaft in accordance with the prior art winding device shown in FIG. 5, wherein the quadruple bearing is designed to be symmetrical with respect to the center MP of the winding shaft. This seating is doubly statically indeterminate.

With the quadruple symmetrical seating of the winding shaft 1, the deformation image shown in FIG. 4 occurs because of the still present own weight of the winding shaft 1, and of the already delivered web of material possibly wound on the winding shaft, but wherein the theoretical center axis of the winding shaft, here identified by N2, remains unchanged in comparison with conventional seating in accordance with FIG. 5. However, as a result the actually occurring flexing D2 of the winding shaft 1 is considerably reduced by means of the represented quadruple symmetrical seating in comparison with conventional double seating.

One reason is that, with the known double seating in accordance with FIG. 5, the load per area of surface between the bearings 2', which is responsible for the flexing D1 of the winding shaft 1, is solely absorbed by the two bearing forces F2 acting on the bearings 2', as shown in FIG. 5.

But with the quadruple symmetrical seating of the winding shaft 1 in accordance with this invention, as shown in FIG. 4, the load per area of surface responsible for the flexing D2 of the winding shaft is absorbed by the bearing forces F3 at the inner bearings 3. Otherwise free ends of the winding shaft 1, which would be bent up because of these forces, are clamped in the opposite direction by the bearing forces F2 on the outer bearings 2. Flexural stresses occur inside the winding shaft 1 because of this, which are directed in the axial direction of the winding shaft 1 and counteract the flexing of the winding shaft 1 because of its own weight and of the web of material possibly already wound on the winding shaft 1. It is possible to considerably reduce the flexing D2 of the quadruple symmetrical seating of the winding shaft in comparison with the flexing D1 of the prior art in accordance with FIG. 5, which can be seen in a comparison of the areas of the cross-hatched surfaces in accordance with the representations in FIGS. 4 and 5. Because of this, the critical bending speed of the winding shaft 1 for one is increased, so that the speed of the delivered web of material can be greater during the start of a winding process, and the result of winding can be considerably improved in comparison with a conventional, double seated rotatable winding shaft 1.

The above explained principle of the quadruple symmetrical seated winding shaft 1 of the winding device is explained in greater detail by means of a structural example in the further drawing figures.

FIG. 6 shows a winding shaft 1, having a winding element 10 and a bearing journal 11 axially projecting in the direction of the center axis MA for rotatable seating of the winding shaft 1 in a winding direction, not shown in the drawings. An inner bearing 3 for the rotatable seating of the winding shaft 1 is provided at each bearing journal 11 in an area 11*a* facing the winding element 10, i.e. facing away from the free end of the bearing journals 11, and also an outer bearing 2 for the rotatable seating of the winding shaft 1 as well in an area 11*b* facing away from the winding element 10, i.e. in the area of the free end of the bearing journal 11.

In order to achieve a quadruple symmetrical seating of the winding shaft 1 in a winding machine, wherein the winding shaft 1 can be inserted in a manner known per se in an automated manner into the winding device and can be removed from the winding device at the termination of the winding process, the inner bearings 3 are permanently connected with the bearing journal 11 of the winding shaft 1, while the outer bearings 2 can be connected with the winding shaft 1 during the winding process by means of a coupling device, and can be disengaged from the winding shaft 1 for removing the winding shaft 1 from the winding device.

Figure 1:
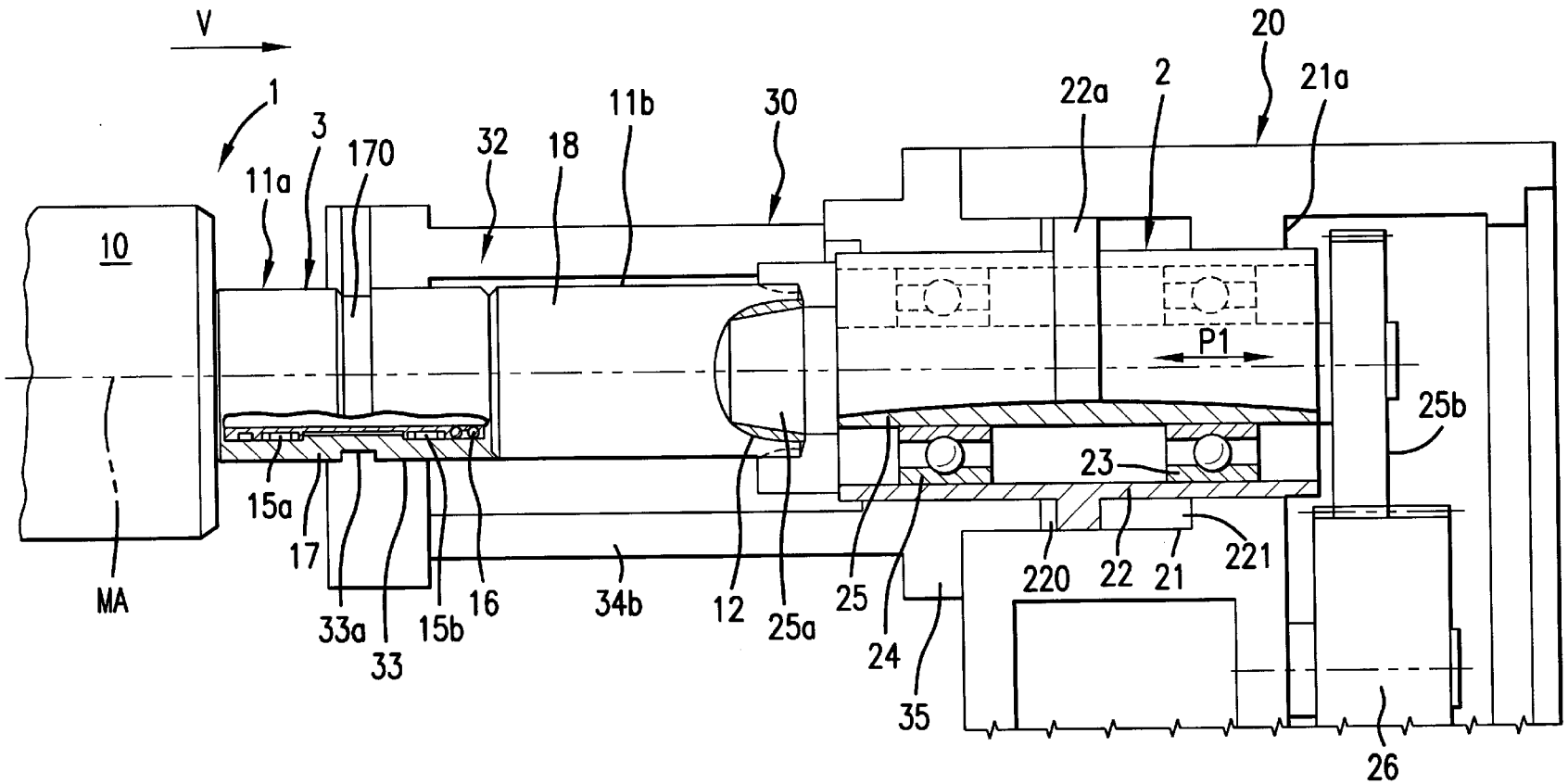
FIG. 1 is a schematic view of a seating of a winding shaft within a winding device of this invention.
Figure 3:
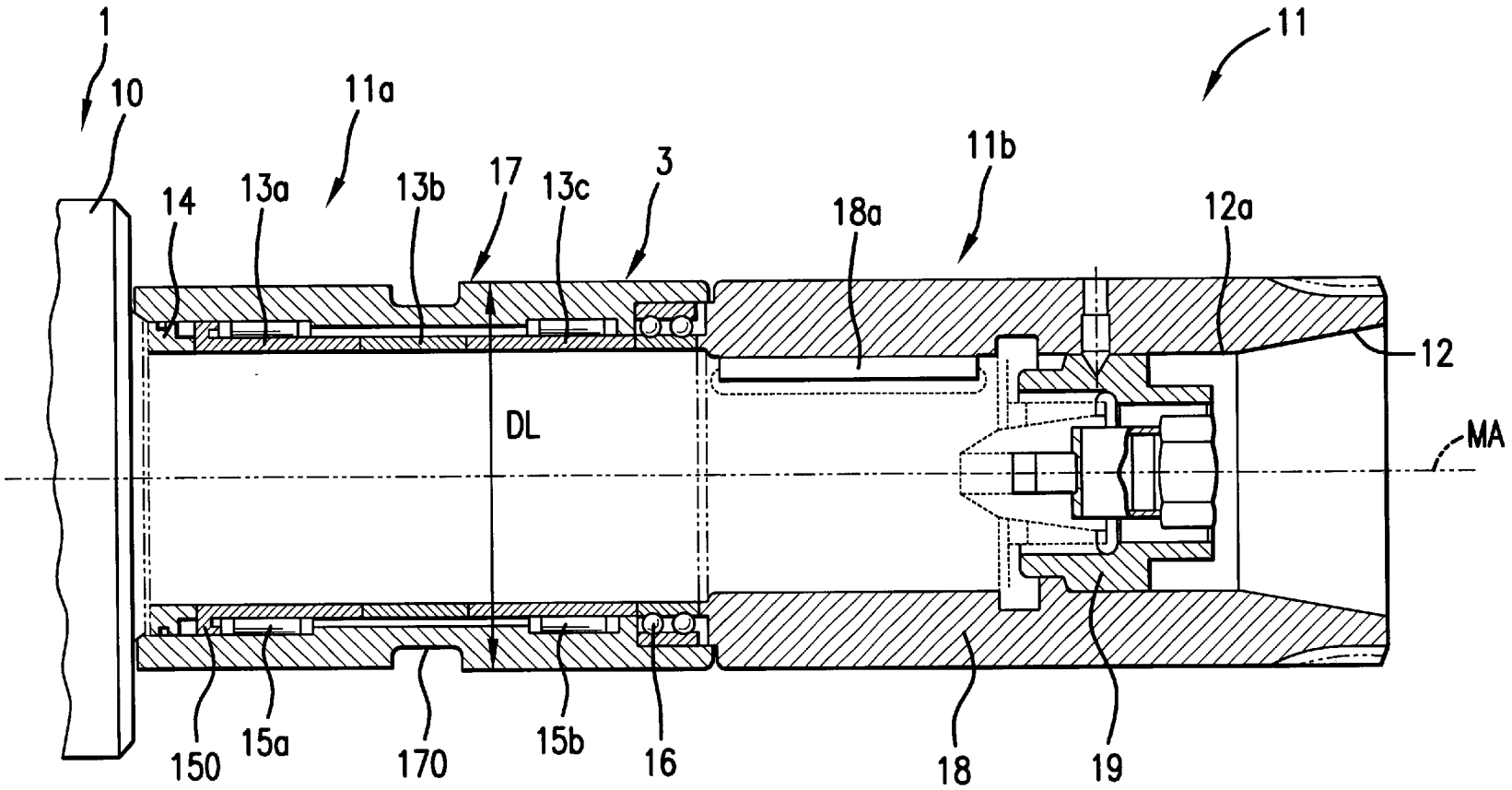
FIG. 3 is an enlarged view of a bearing journal of the winding shaft as shown in FIG. 1.

The design of the inner bearings 3, which are permanently connected with the bearing journal 11 of the winding shaft 1, is shown in greater detail in FIGS. 1 and 3. As shown in FIGS. 1 and 3, initially several rings 13*a*, 13*b*, 13*c*, which adjoin each other, are mounted on the bearing journal 11 in the area 11*a* adjoining the winding element 10 for forming the inner bearing 3 on the bearing journal 11, are fixed in their position toward the winding element 10 by a ring 14, and are bordered toward the free end of the bearing journal 11 by a rolling bearing 16 mounted on the bearing journal 11. A bearing sleeve 17 is pushed onto the bearing journal 11 in the area of the mounted rings 13*a*, 13*b*, 13*c*, which forms an outer end of the bearing journal 11 in the area 11*a*, and which is seated, rotatable around the center axis MA of the winding shaft 1, by means of rolling bearings 15*a*, 15*b*. Here, the rolling bearings 15*a*, 15*b*, are supported on the outside of the rings 13*a*, 13*c*, and are sealed by means of a shaft seal ring 150. The inner bearing 3 for the bearing journal 11 is already formed in this way, wherein the rings 13*a*, 13*c* form the inner housing of the inner bearing 3, and the bearing sleeve 17 forms the outer housing of the inner bearing 3, which can freely rotate by means of the rolling bearings 15*a*, 15*b* around the bearing journal 11 of the winding shaft 1.

A coupling sleeve 18 is mounted on the bearing journal 11 in an area identified by 11*b* toward the free end of the bearing journal 11, which is connected, fixed against relative rotation, with the bearing journal 11 by means of a shaft-hub connection in the form of a feather key 18*a*. Therefore the bearing sleeve 17 of the inner bearing 3 is also seated, freely rotatable around the bearing journal 11, in relation to the coupling sleeve 18, which is connected, fixed against relative rotation, with the bearing journal 11. In order to prevent mutual interference and grinding actions, which could lead to wear, the bearing sleeve 17 is seated, rotatable in relation to the bearing sleeve 11 by means of the rolling bearing 16, in the transition area to the coupling sleeve 18, such as on its end facing the free end of the bearing journal 11, so that contact on the coupling sleeve 18 which there adjoins is prevented.

Toward the free end, the coupling sleeve 18 has a conical clamping bore 12, which is cut axially from the direction of the front and which thereafter transitions into a cylindrical bore element 12*a*, into which a pneumatic valve 19 can be placed, which is used in a manner known per se for the connection with compressed air for the actuation of known clamping jaws, not shown in the drawings for the sake of simplicity, of the winding shaft 1 for clamping a pushed on tube.

The use of a winding shaft 1 constructed in this manner, having inner bearings 3 permanently embodied on the bearing journal 11 within the winding device, which allows an automated insertion and removal of the winding shaft 1, is schematically represented in FIG. 1. For the sake of simplicity, only the portion of a winding device facing one end of the winding shaft 1 is represented in FIG. 1, however, essentially the same arrangement is provided at an opposite end of the winding shaft 1.

The outer bearing 2 is arranged by means of a coupling device in a housing 20 of the winding device, not shown in detail in the drawings, so that, with the winding shaft 1 inserted into the winding device, the outer bearing 2 can be connected with the bearing journal 11 of the winding shaft, and can be brought out of engagement with the bearing journal 11 of the winding shaft 1 for the purpose of removing the winding shaft 1 from the winding device.

Thus the outer bearing 2, which is formed from two bearings 23, 24 to absorb the high flexural stresses, is arranged inside a cylinder 22, which can be axially displaced in accordance with the arrows P1 with respect to the center axis MA of the winding shaft 1, so that the outer bearing 2 is axially displaceable by means of an axial displacement of the cylinder 22. A center shaft 25 is rotatably seated inside the cylinder 22 by means of the bearings 23, 24 forming the outer bearing 2, and has a clamping cone 25*a* on its free end.

Figure 2:
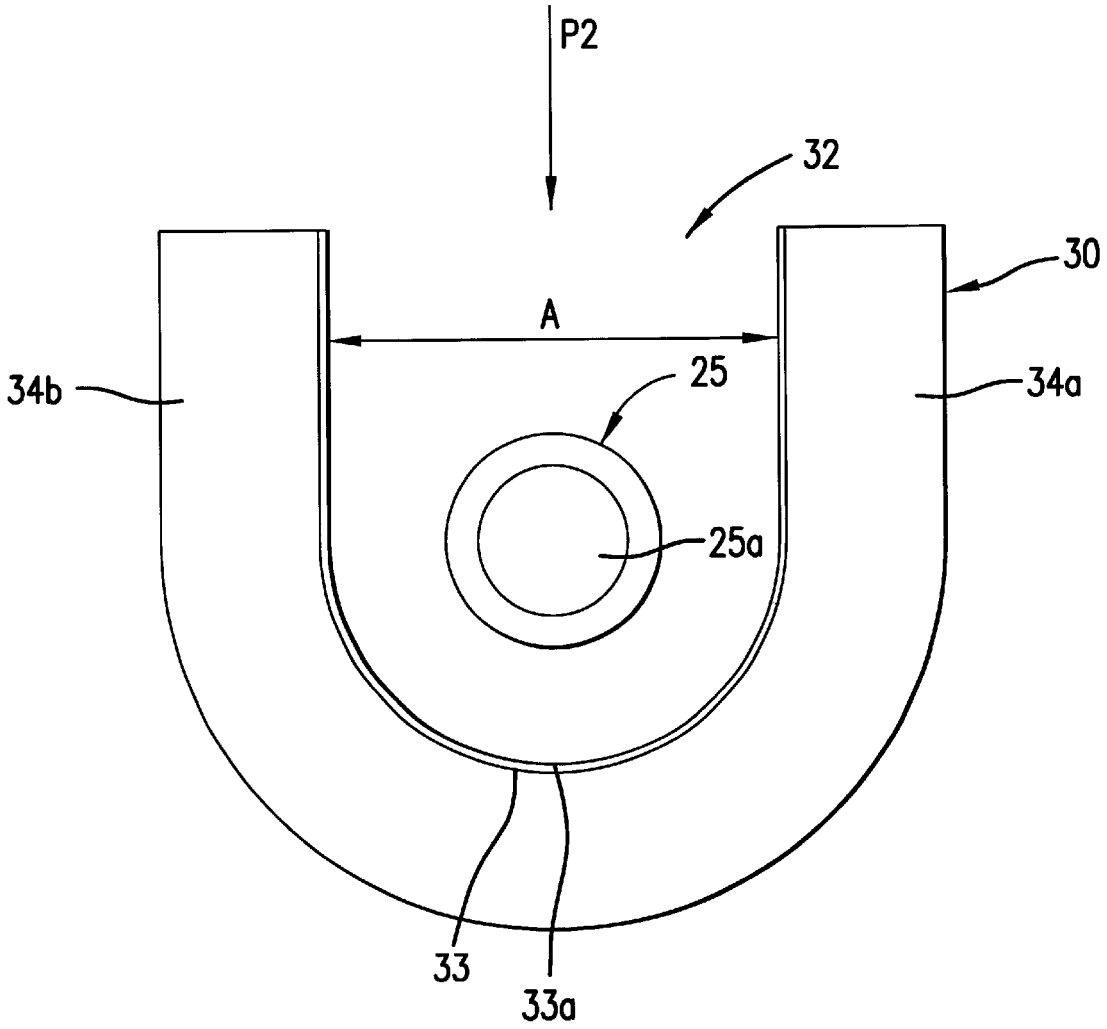
FIG. 2 is a schematic view in a direction of the arrow V, as shown in FIG. 1, on the receiver cup of the winding device of this invention.

As shown in FIG. 2, a receiver cup 30 is fastened on the housing 20 of the winding device placed in front of the center shaft 25, which has an approximately U-shaped cross section, the specific details are shown in FIG. 2. For rotatable seating within the winding device, the winding shaft 1 already explained above can be placed in accordance with the arrow P2 with its bearing journal 11 through an insertion opening 32 into the receiver cup 30, wherein the inner bearing 3, which is permanently connected with the bearing journal 11 of the winding shaft 1, is supported by means of a bearing sleeve 17, shown in FIG. 3, on a correspondingly designed support surface 33 of the receiver cup 30. For introducing and dependably holding the bearing journal 11 in the receiving cup 30, the two legs 34*a*, 34*b* of the receiving cup 30 are arranged in the area of their free ends at a distance A, shown in FIG. 2, which corresponds to the diameter DL, shown in FIG. 3, of the bearing sleeve 17, so that the bearing journal 11 can be inserted in accordance with the arrow P2 through the insertion opening 32 formed between the two legs 34*a*, 34*b* into the bearing cup 30, where it is interlocking held.

In this position of the winding shaft 1, where it is inserted into the bearing cup 30 of the winding device, the winding shaft 1 is already seated, doubly rotatable, within the winding device by means of the resting of the bearing sleeve 17 on the support surface 33 of the bearing cup 30. Now, the center shaft 25, which is rotatably seated by means of the outer bearing 2 in the cylinder 22, is brought into contact with the free end of the bearing journal 11 of the winding shaft 1 by the advancement of the cylinder 22, shown in FIG. 1, toward the left into the position there represented. In the process the clamping cone 25*a* formed on the free end of the center shaft 25 dips into the front-side conical clamping bore 12 of the coupling sleeve 18 and provides a frictional connection between the coupling sleeve 18 and the center shaft 25 if an appropriate contact pressure is provided, so that in the end a frictional connection between the bearing journal 11 of the winding shaft 1 and the outer bearing 2 is also provided. In this position, shown by way of example at one end of the winding shaft 1 in FIG. 1, with the inner bearing 3 resting on the support surface 33 of the receiver cup 30 and the center shaft 25 engaging the conical clamping bore 12, the desired quadruple symmetrical seating of the winding shaft 1 is accomplished, which considerably reduces the flexing of the winding shaft 1 in the manner already explained.

Upon termination of the winding process, the cylinder 22 is displaced toward the right, as shown in FIG. 1, in the direction of the arrow P1 for removing the winding shaft 1, so that the center shaft 25 disengages from the free end of the bearing journal 11 and the winding shaft 1 can be removed from the receiver cup 30, opposite the direction of the arrow P2. From this it is apparent that with an arrangement of the outer bearings inside a coupling device embodied by means of a cylinder, and with the receiver cup 30 fastened thereon following it, the automated insertion and removal of the winding shaft 1 from the winding device in particular is made possible. For this purpose the arrangement shown in FIG. 1 is fastened on pivotable changing arms designed in a manner known per se, but not represented here, which can be pivoted out of a receiving position for the winding shaft 1 into a removal position of the winding shaft 1.

Also as shown in FIG. 1, the support surface 33 of the receiver cup 30 has a projecting strip 33*a*, and the bearing sleeve 17 of the inner bearing 3 with a annular circumferential groove 170, which is engaged by the projecting strip 33*a* at the support surface 33 during the insertion of the winding shaft 1 into the receiver cup 30. Thus an exact guidance of the bearing journal 11 of the winding shaft 1 is achieved when it is inserted into the receiver cup 30, and axial movements of the winding shaft 1 inserted into the receiver cup 30 are prevented as well.

Winding shafts of various diameters of the shaft element 10, for example 3" or 6", can be used in the same way in the winding device represented when the bearing journals 11 are designed in the described way.

The axial movement of the cylinder 22 receiving the outer bearing 2 can take place hydraulically or pneumatically, for example. For this purpose, the cylinder 22 is sealed against an outer cylinder wall 21 by means of an annular circumferential strip 22*a*. The cylinder 22 is sealed on its one axial end by means of a strip 21*a* against the outer cylinder wall 21, while on the side facing the winding shaft 1 sealing is effected by means of a portion of the receiver cup 30 extended via a partial section of the cylinder 22 and identified by element reference numeral 35, which is connected with the housing 20 of the winding device. The receiver cup 30 therefore forms a part of the bearing bracket for the outer bearing 2 in that it forms a portion of the guidance for the cylinder 22 along the displacement path in the arrow direction P1.

In order to make possible the displacement movement of the cylinder 22 with the center shaft 25 arranged therein and rotatably seated in the outer bearing 2 for the purpose of a connection with the winding shaft 1 inserted into the receiver cup 30, or respectively to release this connection, two annular chambers 220, 221 are embodied between the cylinder 22 and the outer cylinder wall 21, which are sealingly separated by means of the projecting strip 22*a*. A hydraulic or pneumatic line, not represented here, leads into each of the annular chambers 220, 221. By an appropriate alternating charging of the lines it is possible to fill the annular chamber 220, or respectively 221, which assures the desired displacement of the cylinder 22 with the center shaft 25 seated therein, and the exertion of a contact pressure sufficient for a force-locking connection with the winding shaft 1.

Moreover, the center shaft 25 can be rotatably driven by means of a rotary drive via pinion gears 26, 25*b* and a drive motor, not represented in detail, in order to provide a rotary drive of the winding shaft 1 connected with the winding shaft 1, in particular with a very productive winding device.

What is claimed is:

1. In a winding device having a winding shaft (1) which is inserted into and removed from the winding device, and a winding element (10) and a plurality of bearing journals (11) protruding from both ends in a direction of a center axis (MA) of the winding shaft (1), wherein the winding device has two outer bearings (2) for receiving the bearing journals (11) for the rotatable seating of the winding shaft (1) in the winding device, and additional bearings for the winding shaft (1) assigned at least one additional bearing, spaced apart, to each outer bearing, the improvement comprising:

each of the outer bearings being equipped with one of a plurality of coupling devices, the coupling devices being displaceable along the center axis (MA) of the winding shaft (1) and connectible with respective ends of the bearing journals (11), and the additional bearings between the ends of the bearing journals (11) which are connectible with the outer bearings and the winding element (10) on the bearing journals (11) of the winding shaft (1) are inner bearings (3) formed by a bearing sleeve (17) pushed on the bearing journal (11) and rotatably seated around the bearing journal (11) by a plurality of bearing elements;

a receiver cup (30) having an approximately U-shaped cross section supporting the inner bearings (3) of the winding shaft (1) which is removably placed in the receiver cup (30) for rotatable seating in the winding device; and an annular circumferential groove (170) on an outside surface of the bearing sleeve (17) of each of the inner bearings (3) corresponding to a projecting strip (33*a*) on the receiver cup (30) so that when the winding shaft (1) is inserted into the receiver cup (30) the projecting strip (33*a*) interlockingly engages the circumferential groove (170) of the bearing sleeve (17).

2. In the winding device in accordance with claim 1, wherein a plurality of strips (34*a, b*) forming the approximately U-shaped cross section of the receiver cup (30) have a distance (A) between support surfaces (33) on free ends of the plurality of strips (34*a, b*) which corresponds to a diameter (DL) of the bearing sleeve (17) of each of the inner bearings (3).

3. In the winding device in accordance with claim 2, wherein the receiver cup (30) extends past the coupling device for the outer bearings (2) and forms a part of a bearing bracket for each of the outer bearings (2).

4. In the winding device in accordance with claim 3, wherein the inner bearings (3) of the winding shaft (1) are rolling bearings.

5. In the winding device in accordance with claim 4, wherein a cylinder (22) which is seated in the winding device and which is axially displaceable with respect to the center axis (MA) of the winding roller (1) forms one of the plurality of coupling devices in which a center shaft (25) is rotatably seated by the outer bearings (2), and during a first displacement of the cylinder (22) toward the winding shaft (1) the center shaft (25) engages with a free end of the bearing journal (11) and rotatably seats the winding shaft (1) in the outer bearings (2) and during a second displacement of the cylinder (22) which is opposite the first displacement, releases the winding shaft (1).

6. In the winding device in accordance with claim 5, wherein a shaft free end of the center shaft (25) has a clamping cone (25*a*) which contacts a conical clamping bore (12) axially cut into the bearing journal (11) at a journal free end.

7. In the winding device in accordance with claim 6, wherein the center shaft (25) is rotatably driven by a rotary drive.

8. In the winding device in accordance with claim 7, wherein on an area (11*b*) facing the journal free end of the bearing journal (11) a coupling sleeve (18) is placed and fixed against relative rotation by a shaft-hub connection (18*a*) with the bearing journal (11) and on a coupling free end of the coupling sleeve (18) a conical clamping bore (12) for engagement by the center shaft (25) is formed.

9. In the winding device in accordance with claim 8, wherein a pneumatic valve for a compressed air connection to the winding shaft (1) is positioned inside the coupling sleeve (18).

10. In the winding device in accordance with claim 9, wherein on a sleeve end facing the coupling sleeve (18) the bearing sleeve (17) is rotatably seated on the bearing journal (11) by a rolling bearing (16).

11. In the winding device in accordance with claim 5, wherein the center shaft (25) is rotatably driven by a rotary drive.

12. In the winding device in accordance with claim 5, wherein on an area (11*b*) facing the journal free end of the bearing journal (11) a coupling sleeve (18) is placed and fixed against relative rotation by a shaft-hub connection (18*a*) with the bearing journal (11) and on a coupling free end of the coupling sleeve (18) a conical clamping bore (12) for engagement by the center shaft (25) is formed.

13. In the winding device in accordance with claim 12, wherein a pneumatic valve for a compressed air connection to the winding shaft (1) is positioned inside the coupling sleeve (18).

14. In the winding device in accordance with claim 8, wherein on a sleeve end facing the coupling sleeve (18) the bearing sleeve (17) is rotatably seated on the bearing journal (11) by a rolling bearing (16).

15. In the winding device in accordance with claim 1, wherein a plurality of strips (34*a, b*) forming the approximately U-shaped cross section of the receiver cup (30) have a distance (A) between support surfaces (33) on free ends of the plurality of strips (34*a, b*) which corresponds to a diameter (DL) of the bearing sleeve (17) of each of the inner bearings (3).

16. In the winding device in accordance with claim 1, wherein the receiver cup (30) extends past the coupling device for the outer bearings (2) and forms a part of a bearing bracket for each of the outer bearings (2).

17. In the winding device in accordance with claim 1, wherein the inner bearings (3) of the winding shaft (1) are rolling bearings.

18. In the winding device in accordance with claim 1, wherein a cylinder (22) which is seated in the winding device and which is axially displaceable with respect to the center axis (MA) of the winding roller (1) forms one of the plurality of coupling devices in which a center shaft (25) is rotatably seated by the outer bearings (2), and during a first displacement of the cylinder (22) toward the winding shaft (1) the center shaft (25) engages with a free end of the bearing journal (11) and rotatably seats the winding shaft (1) in the outer bearings (2) and during a second displacement of the cylinder (22) which is opposite the first displacement, releases the winding shaft (1).

19. In the winding device in accordance with claim 18, wherein a shaft free end of the center shaft (25) has a clamping cone (25*a*) which contacts a corresponding clamping bore (12) axially cut into the bearing journal (11) at a journal free end.

20. In a winding device having a winding shaft (1) which is inserted into and removed from the winding device, and a winding element (10) and a plurality of bearing journals (11) protruding from both ends in a direction of a center axis (MA) of the winding shaft (1), wherein the winding device has two outer bearings (2) for receiving the bearing journals (11) for the rotatable seating of the winding shaft (1) in the winding device, and additional bearings for the winding shaft (1) assigned at least one additional bearing, spaced apart, to each outer bearing, the improvement comprising:

each of the outer bearings being equipped with one of a plurality of coupling devices, the coupling devices being displaceable along the center axis (MA) of the winding shaft (1) and connectible with respective ends of the bearing journals (11), and the additional bearings between the ends of the bearing journals (11) which are connectible with the outer bearings and the winding element (10) on the bearing journals (11) of the winding shaft (1) are inner bearings (3);

a receiver cup (30) having an approximately U-shaped cross section supporting the inner bearings (3) of the winding shaft (1) which is removably placed in the receiver cup (30) for rotatable seating in the winding device; and a bearing sleeve (17) of each of the inner bearings (3) having an annular circumferential groove (170) on an outside surface corresponding with a projecting strip (33*a*) of the receiver cup (30) so that when the winding shaft (1) is inserted into the receiver cup (30) the projecting strip (33*a*) interlockingly engages the circumferential groove (170) of the bearing sleeve (17).

* * * * *